US009340925B2

(12) United States Patent
Mozsgai et al.

(10) Patent No.: US 9,340,925 B2
(45) Date of Patent: May 17, 2016

(54) SPLICE SYSTEMS AND METHODS FOR ROPES

(71) Applicant: Samson Rope Technologies, Ferndale, WA (US)

(72) Inventors: Greg Z. Mozsgai, Blaine, WA (US); Dustin S. Heins, Bellingham, WA (US); Chia-te Chou, Bellingham, WA (US)

(73) Assignee: Samson Rope Technologies, Ferndale, WA (US)

( * ) Notice: Subject to any disclaimer, the term of this patent is extended or adjusted under 35 U.S.C. 154(b) by 134 days.

(21) Appl. No.: 14/210,134

(22) Filed: Mar. 13, 2014

(65) Prior Publication Data

US 2014/0311118 A1 Oct. 23, 2014

Related U.S. Application Data

(60) Provisional application No. 61/799,865, filed on Mar. 15, 2013.

(51) Int. Cl.
*D07B 1/18* (2006.01)
*D07B 7/18* (2006.01)

(52) U.S. Cl.
CPC ..... *D07B 1/185* (2013.01); *D07B 7/169* (2015.07); *D07B 7/18* (2013.01)

(58) Field of Classification Search
CPC ..... D07B 7/16; D07B 7/169; D07B 7/18; D07B 7/185
USPC ..... 57/22, 202
See application file for complete search history.

(56) References Cited

U.S. PATENT DOCUMENTS

| | | | | |
|---|---|---|---|---|
| 429,174 | A | 6/1890 | Ogilvy | |
| 568,531 | A | 9/1896 | Harthan | |
| 1,257,398 | A | 2/1918 | Roach | |
| 1,829,698 | A | 1/1932 | Novotny | |
| 2,299,568 | A | 10/1942 | Dickey | |
| 2,413,642 | A * | 12/1946 | Mitchell | D07B 1/185 87/8 |

(Continued)

FOREIGN PATENT DOCUMENTS

| | | |
|---|---|---|
| EP | 1659209 | 5/2006 |
| EP | 2028308 | 2/2009 |

(Continued)

OTHER PUBLICATIONS

International Searching Authority, ISR, "PCTUS2014026726," Jun. 19, 2014, 7 pages.

(Continued)

*Primary Examiner* — Shaun R Hurley
(74) *Attorney, Agent, or Firm* — Michael R. Schacht; Schacht Law Office, Inc.

(57) ABSTRACT

A rope structure or method of forming a rope structure comprises a rope comprising a plurality of strands. The rope comprises first and second splice locations, an eye region between the first and second splice locations, and a main region. The main region of the rope is located adjacent to the first splice location and in an opposite direction along the rope from the eye region. At least one of the strands is a selected strand. An extracted portion of the at least one selected strand is extracted from the rope and inserted into the rope such that a bridge portion of the at least one selected strand extends between the first and second splice locations and a diameter of the rope is substantially consistent in the main region.

16 Claims, 7 Drawing Sheets

(56) References Cited

U.S. PATENT DOCUMENTS

| | | | | |
|---|---|---|---|---|
| 2,454,592 | A | 11/1948 | Budzinski | |
| 2,482,204 | A | 9/1949 | Peterson | |
| 3,276,810 | A | 10/1966 | Antell | |
| 3,295,303 | A | 1/1967 | Beveridge | |
| 3,411,400 | A | 11/1968 | Morieras et al. | |
| 3,653,295 | A | 4/1972 | Pintard | |
| 3,771,305 | A | 11/1973 | Barnett | |
| 3,904,458 | A | 9/1975 | Wray | |
| 4,036,101 | A | 7/1977 | Burnett | |
| 4,099,750 | A * | 7/1978 | McGrew | D07B 1/185 114/221 R |
| 4,114,360 | A | 9/1978 | Emmons | |
| 4,170,921 | A | 10/1979 | Repass | |
| 4,191,009 | A | 3/1980 | Thomson | |
| 4,286,429 | A | 9/1981 | Lin | |
| 4,414,799 | A | 11/1983 | Alexander et al. | |
| 4,619,108 | A | 10/1986 | Hotta | |
| 4,779,411 | A | 10/1988 | Kendall | |
| 4,974,488 | A * | 12/1990 | Spralja | D04C 1/12 57/202 |
| 6,015,618 | A | 1/2000 | Orima | |
| 6,422,118 | B1 | 7/2002 | Edwards | |
| 7,107,749 | B2 | 9/2006 | Wetzels et al. | |
| 7,127,878 | B1 | 10/2006 | Wilke et al. | |
| 7,134,267 | B1 | 11/2006 | Gilmore et al. | |
| 7,165,485 | B2 | 1/2007 | Smeets et al. | |
| 7,168,231 | B1 | 1/2007 | Chou et al. | |
| 7,367,176 | B1 | 5/2008 | Gilmore et al. | |
| 7,389,973 | B1 | 6/2008 | Chou et al. | |
| 7,437,869 | B1 | 10/2008 | Chou et al. | |
| 7,568,419 | B2 | 8/2009 | Bosman | |
| 7,735,308 | B1 | 6/2010 | Gilmore et al. | |
| 7,739,863 | B1 | 6/2010 | Chou et al. | |
| 7,743,596 | B1 | 6/2010 | Chou et al. | |
| 7,908,955 | B1 | 3/2011 | Chou et al. | |
| 8,109,071 | B2 | 2/2012 | Gilmore | |
| 8,109,072 | B2 | 2/2012 | Chou et al. | |
| 8,171,713 | B2 | 5/2012 | Gilmore et al. | |
| 8,171,714 | B2 | 5/2012 | Wienke et al. | |
| 8,341,930 | B1 | 1/2013 | Chou et al. | |
| 8,381,504 | B2 | 2/2013 | Pettersen | |
| 8,387,505 | B2 | 3/2013 | Chou et al. | |
| 8,511,053 | B2 | 8/2013 | Chou et al. | |
| 8,689,534 | B1 | 4/2014 | Chou | |
| 8,707,666 | B2 | 4/2014 | Crozier et al. | |
| 8,707,668 | B2 | 4/2014 | Gilmore et al. | |
| 2006/0048494 | A1 | 3/2006 | Wetzels et al. | |
| 2012/0266583 | A1 | 10/2012 | Crozier et al. | |
| 2012/0297746 | A1 | 11/2012 | Chou et al. | |
| 2013/0174719 | A1 | 7/2013 | Chou et al. | |
| 2014/0000233 | A1 | 1/2014 | Chou et al. | |
| 2014/0057103 | A1 | 2/2014 | Mozsgai et al. | |
| 2014/0070557 | A1 | 3/2014 | Mozsgai et al. | |
| 2014/0230635 | A1 | 8/2014 | Gilmore et al. | |

FOREIGN PATENT DOCUMENTS

| | | |
|---|---|---|
| EP | 2130969 | 9/2009 |
| RU | 2100674 | 12/1997 |
| SU | 436115 | 7/1974 |
| SU | 618061 | 7/1978 |
| SU | 1647183 | 5/1991 |
| WO | 2008144046 | 11/2008 |
| WO | 2008144047 | 11/2008 |
| WO | 2008144048 | 11/2008 |
| WO | 2013134033 A1 | 9/2013 |
| WO | 2014043136 | 3/2014 |
| ZA | 2009008815 | 8/2010 |

OTHER PUBLICATIONS

Wire Rope Technical Board, "Mechanical Splice (Flemish eye)," Wire Rope Sling Users Manual, Third Edition, 2007, p. 12, WRBT Publications, USA.

* cited by examiner

PRIOR ART

SPLICE SYSTEMS AND METHODS FOR ROPES

RELATED APPLICATIONS

This application, U.S. patent application Ser. No. 14/210,134 filed Mar. 13, 2014 claims benefit of U.S. Provisional Application Ser. No. 61/799,865 filed Mar. 15, 2013, the contents of which are incorporated herein by reference.

TECHNICAL FIELD

The present invention relates to rope termination structures and methods and, more particularly, to structures and methods of forming splices such as eye splices.

BACKGROUND

Ropes are typically configured to transfer a load between two structures. To facilitate the transfer of the load from each of the structures to the rope, the rope ends must be secured to the each structure. One method of securing a rope end to a structure is simply to tie or wrap the end of the rope to the structure or a specially designed piece of hardware rigidly connected to the structure.

Alternatively, the rope may be terminated at one end or both ends to facilitate the mechanical engagement of the rope to the structure or associated hardware. One method of terminating a rope is to form what is typically referred to as an eye at an end of the rope. A rope eye defines a closed loop that may be placed over the structure or associated hardware.

To form an eye, the rope is looped to form the eye and then spliced back into itself in a splice region adjacent to the eye. Typically splicing techniques result in a thickened rope portion in the splice region adjacent to the eye. Such thickened rope portions can adversely affect the operation of the rope in some operating environments, and the need thus exists for rope structures and methods of forming rope structures that do not result in a thickened rope portion adjacent to the eye.

SUMMARY

The present invention may be embodied as a method of forming a rope structure comprising the following steps. A rope comprising a plurality of strands is provided. First and second splice locations on the rope are defined. An eye region of the rope between the first and second splice locations is defined. A main region of the rope is defined. The main region of the rope is located adjacent to the first splice location and in an opposite direction along the rope from the eye region. At least one of the strands is identified as a selected strand. An extracted portion of the at least one selected strand is extracted from the rope. The extracted portion of the at least one selected strand is inserted into the rope such that a bridge portion of the at least one selected strand extends between the first and second splice locations and a diameter of the rope is substantially consistent in the main region.

The present invention may also be embodied as a rope structure comprising a rope comprising a plurality of strands and defining first and second splice locations on the rope, an eye region of the rope between the first and second splice locations, and a main region. The main region of the rope is located adjacent to the first splice location and in an opposite direction along the rope from the eye region. An extracted portion of at least one selected strand from the rope is inserted into the rope such that the at least one selected strand forms a bridge portion that extends between the first and second splice locations and a diameter of the rope is substantially consistent in the main region.

The present invention may also be embodied as a method of forming a rope structure comprising the following steps. A rope comprising a plurality of strands is provided. First and second splice locations on the rope are defined. An eye region of the rope between the first and second splice locations is defined. An end region of the rope is defined. The end region of the rope is located adjacent to the second splice location and in an opposite direction along the rope from the eye region. At least one of the strands is identified as a selected strand. An extracted portion of the at least one selected strand is extracted from the eye region and the end region of the rope. The extracted portion of the at least one selected strand is inserted into the eye region of the rope such that a bridge portion of the at least one selected strand extends between the first and second splice locations.

The present invention may also be embodied as a method of forming a rope structure comprising the following steps. A rope comprising a plurality of strands is provided. First and second splice locations on the rope are defined. An eye region of the rope between the first and second splice locations is defined. An end region of the rope is defined. The end region of the rope is located adjacent to the second splice location and in an opposite direction along the rope from the eye region. The step of extracting the extracted portion of the at least one selected strand from the rope comprises the step of extracting the extracted portion of the at least one selected strand from the end region. A main region of the rope is defined. The main region of the rope is located adjacent to the first splice location and in an opposite direction along the rope from the eye region. At least one of the strands is identified as a selected strand. An extracted portion of the at least one selected strand is extracted from the end region of the rope. A cut portion of the at least one selected strand is removed from the main region of the rope. The extracted portion of the at least one selected strand is inserted into the main region of the rope such that a bridge portion of the at least one selected strand extends between the first and second splice locations.

DETAILED DESCRIPTION

Figure 1:
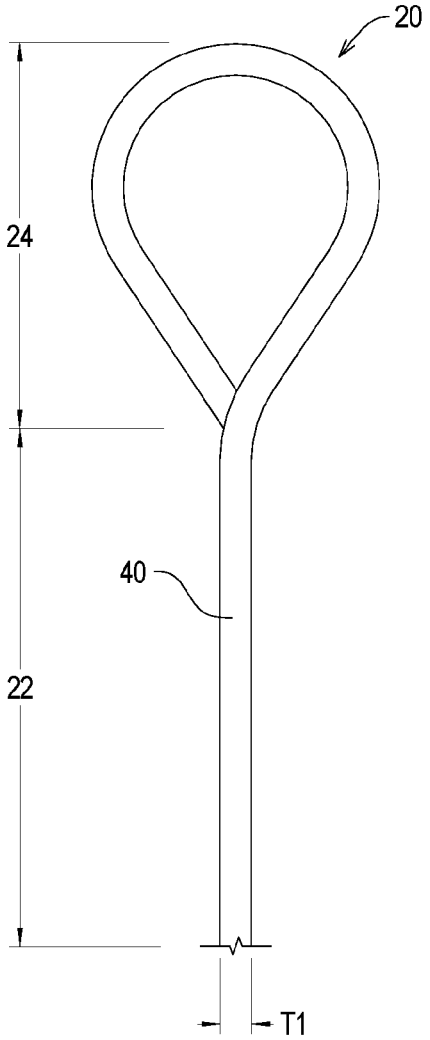
FIG. 1 is a plan view of a first example rope structure of the present invention.

Referring initially to FIG. 1 of the drawing, depicted therein is first example rope structure 20 constructed in accordance with, and embodying, the principles of the present invention. The first example rope structure 20 comprises a main region 22 and an eye region 24. The present invention is described herein with reference to the formation of an eye splice, but the principles of the present invention may have application to other splice constructions.

Figure 2:
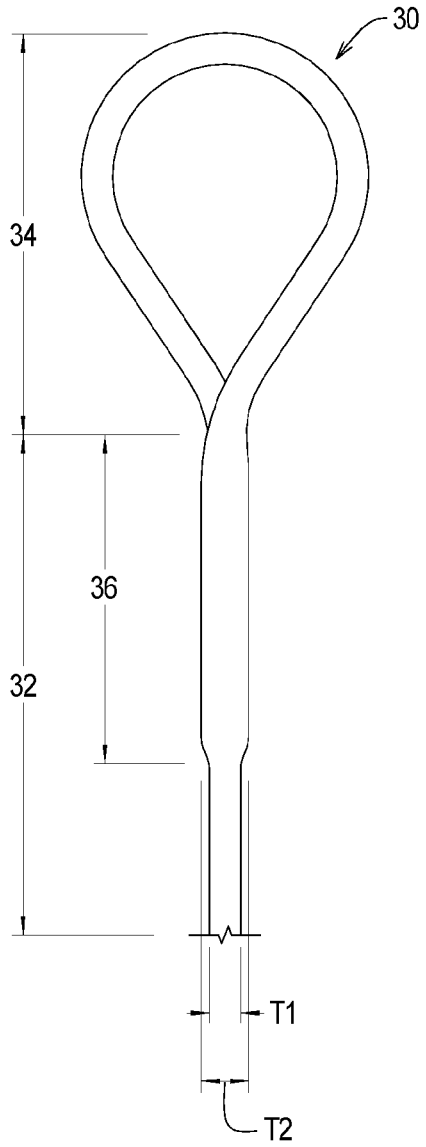
FIG. 2 is a plan view of a conventional rope structure.

FIG. 2 illustrates a conventional rope structure 30 comprising a main region 32, an eye region 34, and a splice region 36. Comparing the first example rope structure 20 with the conventional rope structure 30, it can be seen that the first example rope structure 20 does not contain a clearly defined splice region such as the splice region 36 defined by the conventional rope structure 30. FIG. 1 illustrates that a thickness T1 of the first example rope structure 20 is substantially constant, while the splice region 36 of the conventional rope structure 30 has a thickness T2 that is visibly larger than the thickness T1 of the rope structure 30 in the main region 32 and the eye region 34.

Figure 3:
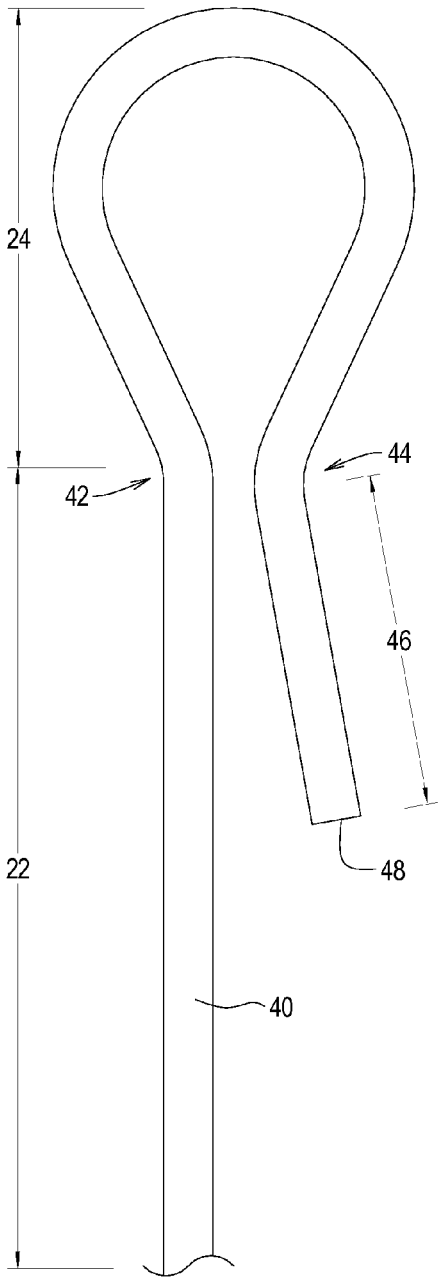
FIG. 3 is a plan view illustrating steps of forming the first example rope structure.

Turning now to FIGS. 3-7 of the drawing, a process of forming the first example rope structure 20 will now be described in further detail. As shown in FIG. 3, a rope member 40 is provided, and the parameters of the eye region 24 are defined. Once the parameters of the eye region 24 have been defined, a first splice location 42, a second splice location 44, and a rope end region 46 containing an end 48 of the rope structure are defined relative to the rope member 40.

Figure 4:
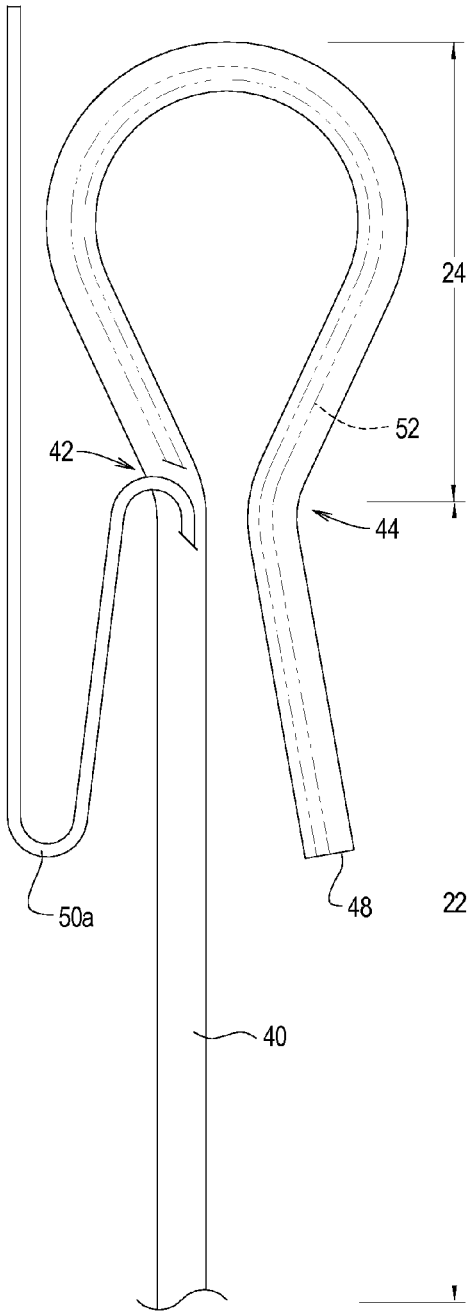
FIG. 4 is a plan view illustrating additional steps of forming the first example rope structure.
Figure 5:
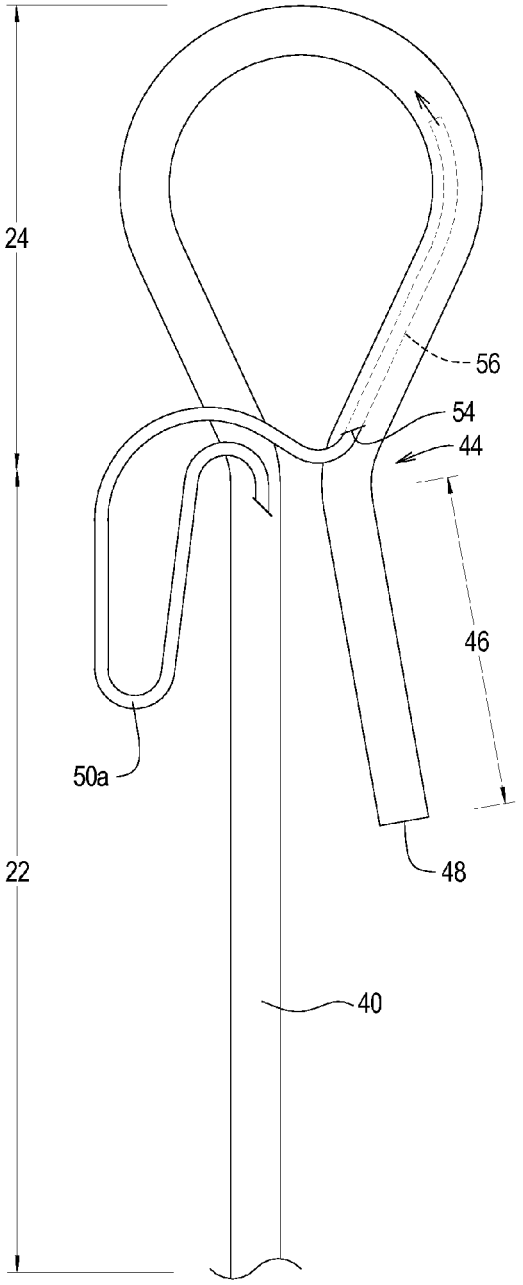
FIG. 5 is a plan view illustrating additional steps of forming the first example rope structure.

Next, as shown in FIG. 4, a strand 50*a* is extracted from the rope structure 40 from the first splice location 42 to the end 48 of the rope structure 40. An original strand location 52 from which the strand 50*a* was removed is indicated by broken lines in FIG. 4. As shown in FIG. 5, the strand 50*a* is inserted back into the rope structure 40 at a new strand insert point 54 at the second splice location 44. The strand 50*a* is woven, tucked, braided, or otherwise arranged along a new strand path 56 back through the eye region 24 and to a new strand extraction point 58 at the first splice location 42.

Figure 6:
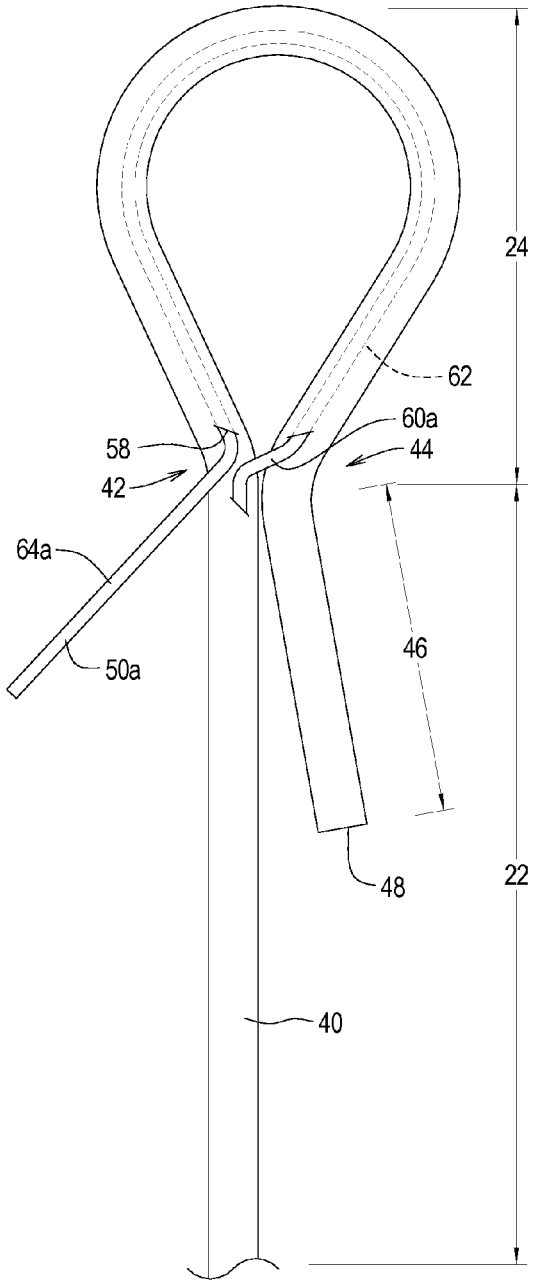
FIG. 6 is a plan view illustrating additional steps of forming the first example rope structure.

As shown in FIG. 6, a bridge portion 60*a* of the strand 50*a* crosses over from the first splice location 42 to the second splice location 44, and the strand 50*a* lies in a new strand location 62. A strand free end 64*a* of the strand 50*a* is extracted from the rope structure 40 at the strand extraction point 58.

The process of selecting a strand from the rope structure, removing the selected strand from its original strand location between the first splice location and the rope end, inserting the selected strand back into the rope structure at a new rope insertion point at the second splice location and along a new strand path back to the first splice location, and out of the rope structure at a new strand extraction point at the first splice location, is repeated until a desired number of strands have been used to form the eye splice. Typically, half of the strands forming the original rope structure are removed and used to form the splice as described herein.

The example rope structure 40 depicted in FIGS. 1-7 is a 12 strand braided rope, so six strands 50*a*, 50*b*, 50*c*, 50*d*, 50*e*, and 50*f* are removed and inserted back through the eye region to form the eye splice. The use of six strands to form the eye splice results in six bridge portions crossing from the first splice location 42 to the second splice location 44, although only two bridge portions 60*a* and 60*b* are visible in the two-dimensional representation of the rope structure 20 in FIG. 7. The use of six strands to form the eye splice further results in six strand free ends 64*a*, 64*b*, 64*c*, 64*d*, 64*e*, and 64*f* exiting the rope structure at the second splice location 44 as further depicted in FIG. 7.

Figure 7:
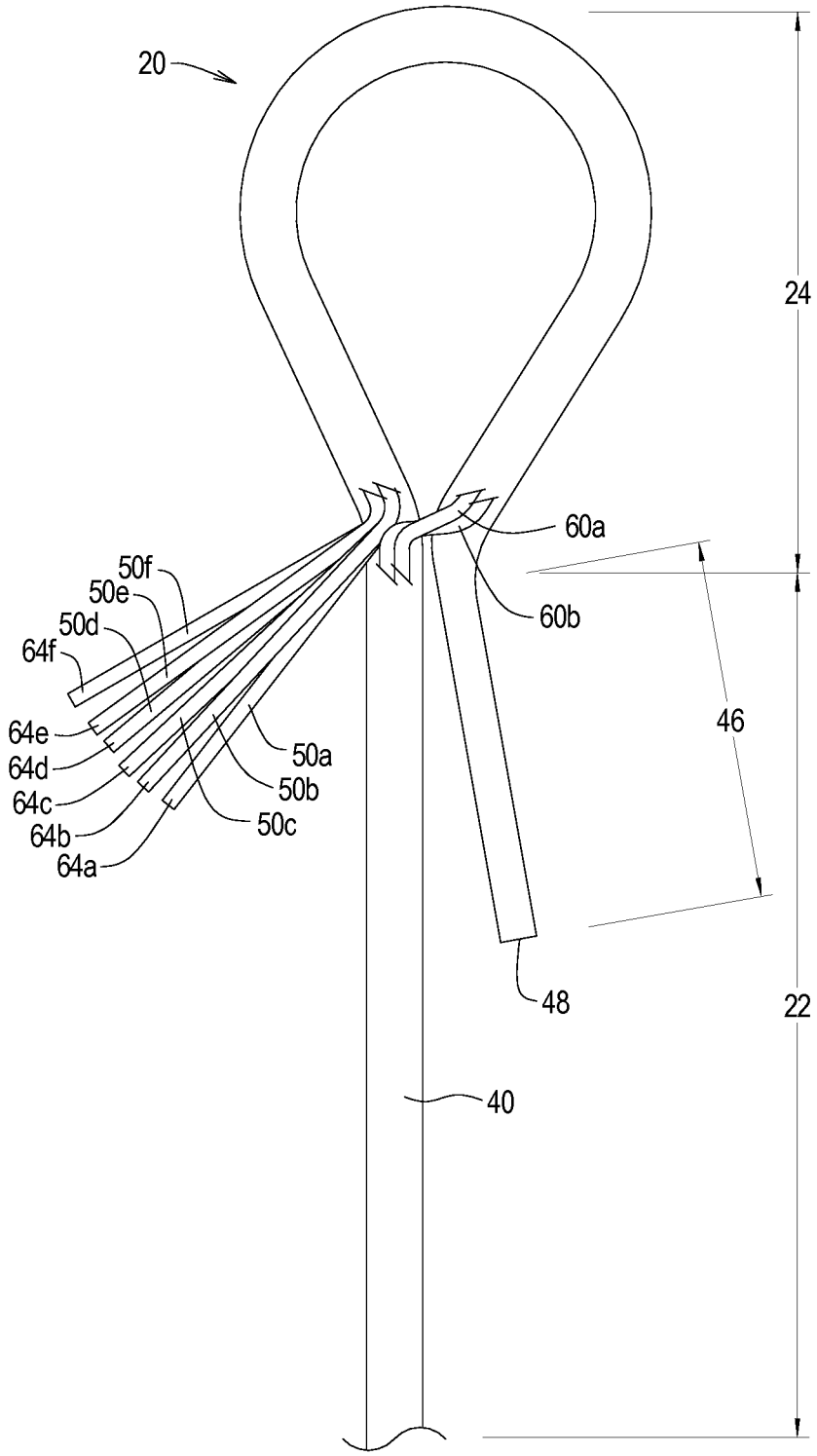
FIG. 7 is a plan view illustrating the first example rope structure prior to optional final steps of forming the first example rope structure.

After the rope structure 20 has been formed as depicted in FIG. 7, the rope end region 46 and the strand free ends 64*a*, 64*b*, 64*c*, 64*d*, 64*e*, and 64*f* may be removed and the cut ends of the strands 50*a*, 50*b*, 50*c*, 50*d*, 50*e*, and 50*f*, as well as the remaining strands of the twelve strand braided rope in the rope end region 46, may be appropriately terminated to secure the rope structure 20 in its configuration as depicted in FIG. 1.

Turning now to FIGS. 8-12 of the drawing, a process of forming a second example rope structure 120 that has a geometry similar to that of the first example rope structure 20 will now be described. Like the first example rope structure 20, the second example rope structure 120 comprises a main region 122 and an eye region 124.

Figure 8:
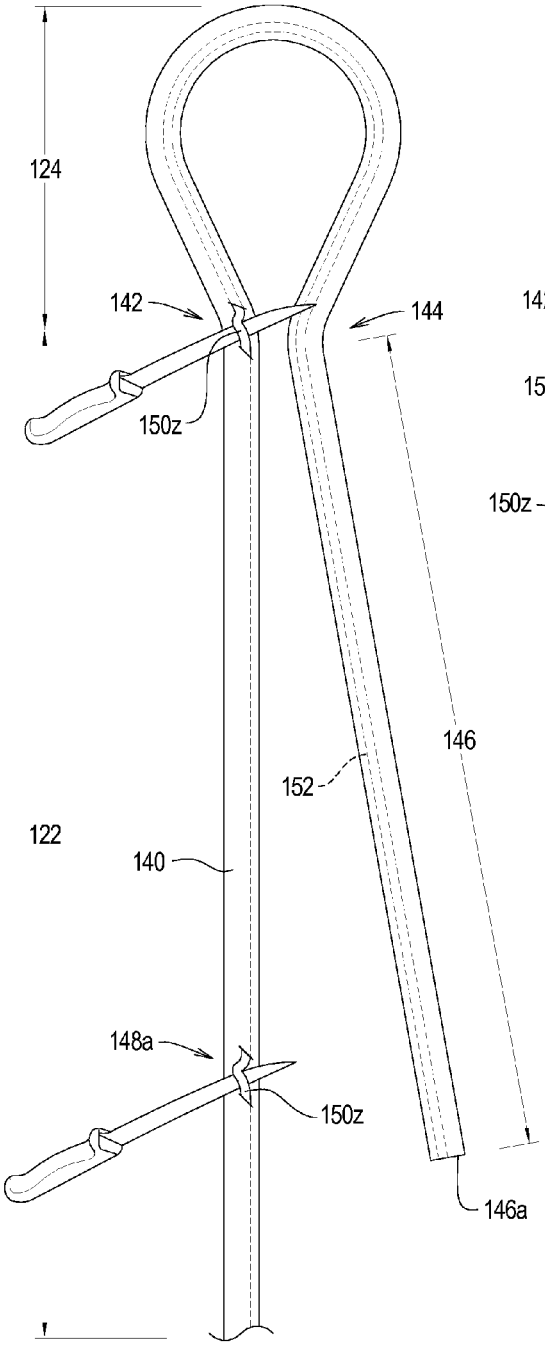
FIG. 8 is a plan view illustrating steps of forming a second example rope structure of the present invention.

As shown in FIG. 8, a rope member 140 is initially provided, and the parameters of the eye region 124 are defined. Once the parameters of the eye region 124 have been defined, a first splice location 142, a second splice location 144, and a rope end region 146 containing an end 146*a* of the rope structure are defined relative to the rope member 140.

Next, as shown in FIG. 8, a first cut region 148*a* generally corresponding to a length of the rope end region 146, but typically slightly shorter, is identified. A selected strand 150*z* is cut at the first splice region 142 and at the first cut region 148*a*, and the portion of the strand 150*z* between these two cuts is extracted from the rope structure 140 as shown in FIG. 9.

Figure 9:
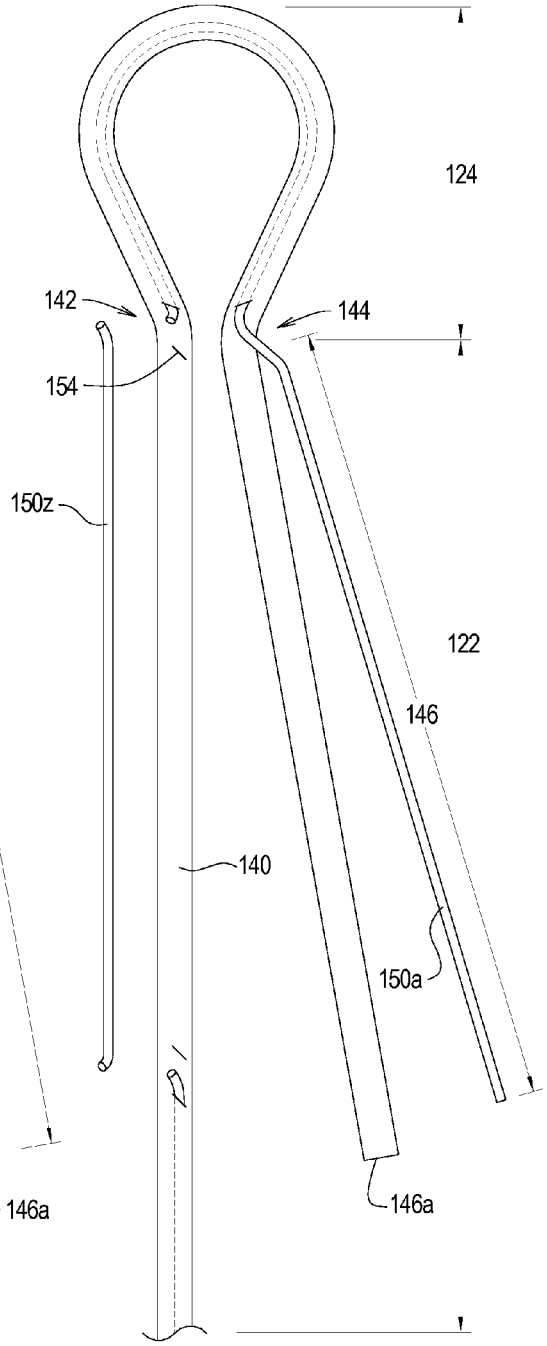
FIG. 9 is a plan view illustrating additional steps of forming the second example rope structure of the present invention.

The portion of another, uncut strand 150*a* in the rope end region 146 between the second splice location 144 to the rope end 146*a* is removed from the rope structure 140 as also shown in FIG. 9. An original strand location 152 from which the strand 150*a* is removed is indicated by broken lines in FIG. 8.

Figure 10:
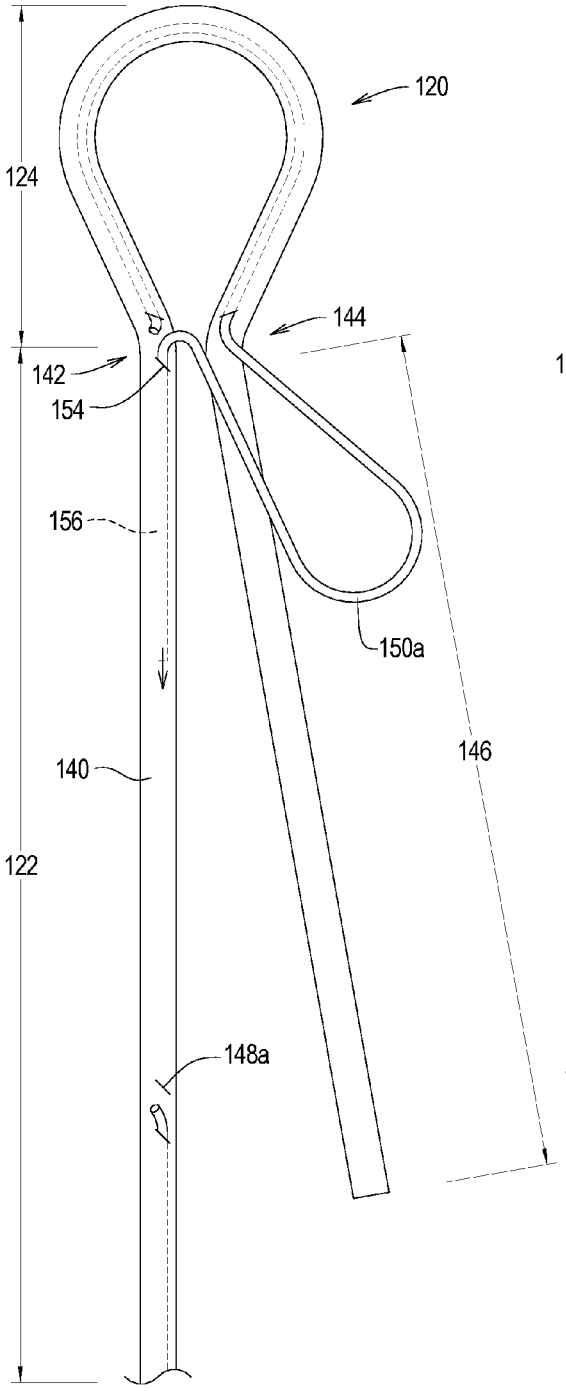
FIG. 10 is a plan view illustrating additional steps of forming the second example rope structure of the present invention.

As shown in FIGS. 9 and 10, the selected, uncut strand 150*a* is then inserted back into the rope structure 140 at a new strand insert point 154 at the first splice location 142. The selected strand 150*a* is woven, tucked, braided, or otherwise arranged along a new strand path 156 from the first splice location 142 to the first cut region 148*a* as further shown in FIG. 10.

Figure 11:
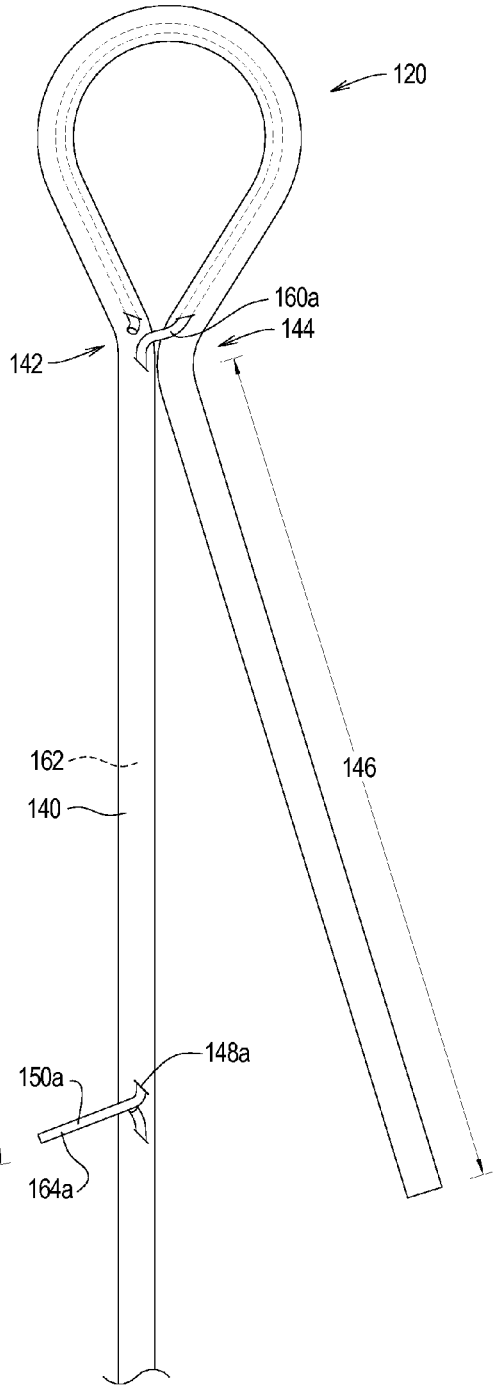
FIG. 11 is a plan view illustrating additional steps of forming the second example rope structure of the present invention.

As shown in FIG. 11, a bridge portion 160*a* of the strand 150*a* crosses over from the second splice location 144 to the first splice location 142, and the strand 150*a* lies in a new strand location 162. A strand free end 164*a* of the strand 150*a* is extracted from the rope structure 140 at the first cut region 148*a*.

Figure 12:
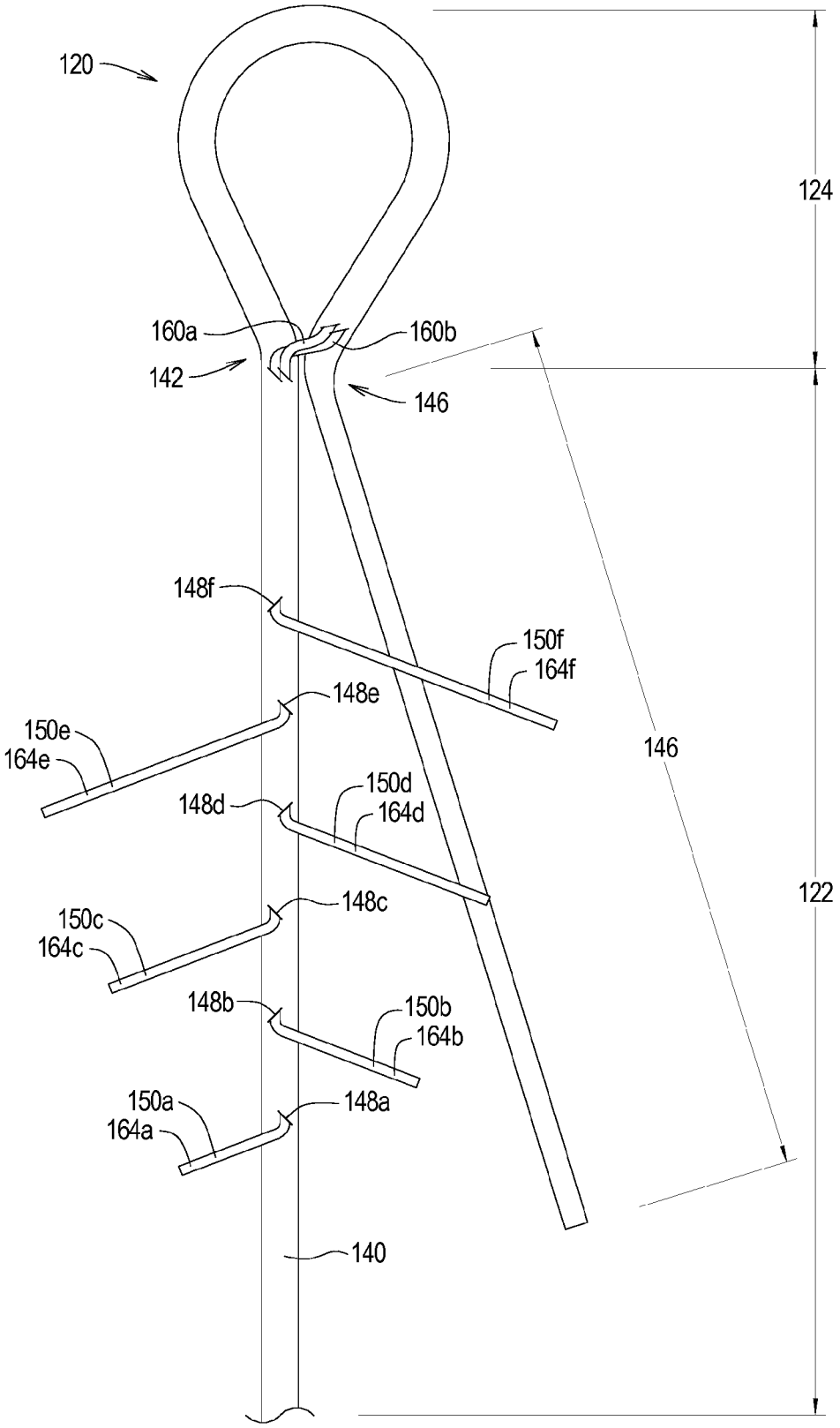
FIG. 12 is a plan view illustrating the second example rope structure prior to optional final steps of forming the second example rope structure.

The process depicted in FIGS. 8-11 is repeated until a desired number of strands have been used to form the eye splice as shown in FIG. 12. Typically, half of the strands forming the original rope structure are removed and used to form the splice as described herein. The example depicted in FIGS. 8-12 depicts the formation of an eye splice in a twelve-strand braided rope, so six strand cut regions 148*a*, 148*b*, 148*c*, 148*d*, 148*e*, and 148*f* and six strand free ends 164*a*, 164*b*, 164*c*, 164*d*, 164*e*, and 164*f* are defined, one for each of the strands 150*a*, 150*b*, 150*c*, 150*d*, 150*e*, and 150*f*. FIG. 12 also shows that the example strand cut regions 148*b*, 148*c*, 148*d*, 148*e*, and 148*f* are staggered back from the first strand cut region 148*a* towards the first splice location 142.

The use of six strands to form the eye splice results in six bridge portions crossing from the first splice location 142 to the second splice location 146, although only two bridge portions 160*a* and 160*b* are visible in the two-dimensional representation of the rope structure 120 in FIG. 12.

After the rope structure 120 has been formed as depicted in FIG. 12, the rope end region 146 and the strand free ends 164*a*, 164*b*, 164*c*, 164*d*, 164*e*, and 164*f* may be removed and the cut ends of the strands 150*a*, 150*b*, 150*c*, 150*d*, 150*e*, and 150*f*, as well as the remaining strands of the twelve-strand braided rope in the rope end region 146, may be appropriately terminated to secure the rope structure 120 in a configuration that looks like the rope structure 20 depicted in FIG. 1.

What is claimed is:

1. A method of forming a rope structure comprising the steps of:

providing a rope comprising a plurality of stands;

defining first and second splice locations on the rope;

defining an eye region of the rope between the first and second splice locations;

defining a main region of the rope, where the main region of the rope is located adjacent to the first splice location and in an opposite direction along the rope from the eye region;

identifying at least one of the strands as a selected strand;

extracting an extracted portion of the at least one selected strand from the rope; and inserting the extracted portion of the at least one selected strand into the rope such that a bridge portion of the at least one selected strand extends between the first and second splice locations, and a diameter of the rope is substantially consistent in the main region.

2. A method as recited in claim 1, in which:

the step of extracting the extracted portion of the at least one selected strand from the rope comprises the step of extracting extracted portions of a plurality of selected strands from the rope; and the step of inserting the extracted portion of the at least one of the strands back into the rope comprises the step of inserting the extracted portions of the plurality of selected strands back into the rope such that a plurality of bridge portions extend between the first and second splice locations.

3. A method as recited in claim 1, further comprising the step of defining an end region of the rope, in which:

the end region of the rope is located adjacent to the second splice location and in an opposite direction along the rope from the eye region; and the step of extracting the extracted portion of the at least one selected strand from the rope comprises the step of extracting the extracted portion of the at least one selected strand from the eye region and the end region; and the step of inserting the extracted portion of the at least one selected strand into the rope comprises the step of inserting the extracted portion of the at least one selected strand into the eye region of the rope.

4. A method as recited in claim 2, further comprising the step of defining an end region of the rope, in which:

the end region of the rope is located adjacent to the second splice location and in an opposite direction along the rope from the eye region; and the step of extracting the extracted portions of the plurality of selected strands from the rope comprises the step of extracting the extracted portions of the plurality of selected strands from the eye region and the end region; and the step of inserting the extracted portions of the plurality of selected strands from the rope comprises the step of inserting the extracted portions of the plurality of selected strands into the eye region of the rope.

5. A method as recited in claim 1, further comprising the steps of:

defining an end region of the rope, where the end region of the rope is located adjacent to the second splice location and in an opposite direction along the rope from the eye region, and the step of extracting the extracted portion of the at least one selected strand from the rope comprises the step of extracting the extracted portion of the at least one selected strand from the end region; and removing a cut portion of the at least one selected strand from the main region.

6. A method as recited in claim 2, further comprising the steps of:

defining an end region of the rope, where the end region of the rope is located adjacent to the second splice location and in an opposite direction along the rope from the eye region, and the step of extracting the extracted portions of the plurality of selected strands from the rope comprises the step of extracting the extracted portions of the plurality of selected strands from the end region; and removing a cut portion of each of the selected strands from the main region.

7. A rope structure comprising:

a rope comprising a plurality of stands and defining first and second splice locations on the rope, an eye region of the rope between the first and second splice locations, and a main region, where the main region of the rope is located adjacent to the first splice location and in an opposite direction along the rope from the eye region; and an extracted portion of at least one selected strand from the rope is inserted into the rope such that the at least one selected strand forms a bridge portion that extends between the first and second splice locations, and a diameter of the rope is substantially consistent in the main region.

8. A rope structure as recited in claim 7, in which:

extracted portions of a plurality of selected strands are extracted from the rope; and the extracted portions of the plurality of selected strands are inserted back into the rope to form a plurality of bridge portions that extend between the first and second splice locations.

9. A rope structure as recited in claim 7, in which:

an end region of the rope is located adjacent to the second splice location and in an opposite direction along the rope from the eye region;

the extracted portion of the at least one selected strand is extracted from the eye region and the end region; and the extracted portion of the at least one selected strand is inserted into the eye region of the rope.

10. A rope structure as recited in claim 8, in which:

an end region of the rope is located adjacent to the second splice location and in an opposite direction along the rope from the eye region;

the extracted portions of the plurality of selected strands are extracted from the end region; and the extracted portions of the plurality of selected strands are inserted into the eye region of the rope.

11. A rope structure as recited in claim 7, in which:

the rope defines an end region, where the end region of the rope is located adjacent to the second splice location and in an opposite direction along the rope from the eye region, and the extracted portion of the at least one selected strand is extracted from the end region;

the rope defines a main region, where the main region of the rope is located adjacent to the first splice location and in an opposite direction along the rope from the eye region; and a cut portion of the at least one selected strand is removed from the main region.

12. A rope structure as recited in claim 8, in which:

the rope defines an end region, where the end region of the rope is located adjacent to the second splice location and in an opposite direction along the rope from the eye region, and the extracted portions of the plurality of selected strands are extracted from the end region;

the rope defines a main region, where the main region of the rope is located adjacent to the first splice location and in an opposite direction along the rope from the eye region; and a cut portion of each of the selected strands is removed from the main region.

13. A method of forming a rope structure comprising the steps of:

providing a rope comprising a plurality of stands;

defining first and second splice locations on the rope;

defining an eye region of the rope between the first and second splice locations;

defining an end region of the rope, where the end region of the rope is located adjacent to the second splice location and in an opposite direction along the rope from the eye region;

identifying at least one of the strands as a selected strand;

extracting an extracted portion of the at least one selected strand from the eye region and the end region of the rope; and inserting the extracted portion of the at least one selected strand into the eye region of the rope such that a bridge portion of the at least one selected strand extends between the first and second splice locations.

14. A method as recited in claim 13, in which:

the step of extracting the extracted portion of the at least one selected strand from the eye region and the end region of the rope comprises the step of extracting extracted portions of a plurality of selected strands from the eye region and the end region rope; and the step of inserting the extracted portion of the at least one of the strands back into the rope comprises the step of inserting the extracted portions of the plurality of selected strands back into the splice portion of the rope such that a plurality of bridge portions extend between the first and second splice locations.

15. A method of forming a rope structure comprising the steps of:

providing a rope comprising a plurality of stands;

defining first and second splice locations on the rope;

defining an eye region of the rope between the first and second splice locations;

defining an end region of the rope, where the end region of the rope is located adjacent to the second splice location and in an opposite direction along the rope from the eye region, and the step of extracting the extracted portion of the at least one selected strand from the rope comprises the step of extracting the extracted portion of the at least one selected strand from the end region;

defining a main region of the rope, where the main region of the rope is located adjacent to the first splice location and in an opposite direction along the rope from the eye region; and identifying at least one of the strands as a selected strand;

extracting an extracted portion of the at least one selected strand from the end region of the rope;

removing a cut portion of the at least one selected strand from the main region of the rope; and inserting the extracted portion of the at least one selected strand into the main region of the rope such that a bridge portion of the at least one selected strand extends between the first and second splice locations.

16. A method as recited in claim 15, in which:

the step of extracting the extracted portion of the at least one selected strand from the end region of the rope comprises the step of extracting extracted portions of a plurality of selected strands from the end region rope; and the step of inserting the extracted portion of the at least one of the strands back into the rope comprises the step of inserting the extracted portions of the plurality of selected strands back into the main portion of the rope such that a plurality of bridge portions extend between the first and second splice locations.

* * * * *